US007004728B2

(12) United States Patent
Soares

(10) Patent No.: US 7,004,728 B2
(45) Date of Patent: Feb. 28, 2006

(54) GAS PRESSURE DRIVEN FLUID PUMP HAVING AN ELECTRONIC CYCLE COUNTER AND METHOD

(75) Inventor: Jairo Luiz Soares, Sao Paulo (BR)

(73) Assignee: Spirax Sarco, Inc., Blythwood, SC (US)

( * ) Notice: Subject to any disclaimer, the term of this patent is extended or adjusted under 35 U.S.C. 154(b) by 123 days.

(21) Appl. No.: 10/819,904

(22) Filed: Apr. 7, 2004

(65) Prior Publication Data

US 2005/0226734 A1 Oct. 13, 2005

(51) Int. Cl.

| | |
|---|---|
| ***F04B 49/00*** | (2006.01) |
| ***F04F 1/06*** | (2006.01) |
| ***G01M 19/00*** | (2006.01) |
| ***G01F 23/30*** | (2006.01) |

(52) U.S. Cl. ..... 417/63; 417/133; 417/137

(58) Field of Classification Search ..... 417/63, 417/130, 131, 132, 137, 138; 73/168, 310; 137/551, 558

See application file for complete search history.

(56) References Cited

U.S. PATENT DOCUMENTS

| | | | | |
|---|---|---|---|---|
| 4,265,262 | A * | 5/1981 | Hotine | 137/2 |
| 4,578,186 | A * | 3/1986 | Morin | 210/90 |
| 5,117,677 | A | 6/1992 | Hendershot et al. | |
| 5,125,801 | A | 6/1992 | Nabity et al. | |
| 5,419,191 | A | 5/1995 | Niehaus et al. | |
| 5,517,008 | A | 5/1996 | Francart, Jr. | |
| 5,547,345 | A | 8/1996 | North, III et al. | |
| 5,549,157 | A | 8/1996 | Johnson et al. | |
| 5,672,050 | A | 9/1997 | Webber et al. | |
| 5,938,409 | A | 8/1999 | Radle, Jr. et al. | |
| 6,254,351 | B1 | 7/2001 | Culp | |
| 6,439,856 | B1 | 8/2002 | Ivey | |

OTHER PUBLICATIONS

International Search Report in relation to Applicant's corresponding PCT application serial No. PCT/US2005/011571 filed Apr. 4, 2005.

* cited by examiner

*Primary Examiner*—Charles G. Freay
(74) *Attorney, Agent, or Firm*—Nelson Mullins Riley & Scarborough, LLP

(57) ABSTRACT

A gas pressure driven fluid pump having an electronic cycle counter. The pump has a pump tank with a liquid inlet and a liquid outlet. A switching mechanism is operative within the pump tank for switching to exhaust porting when the fluid level within the pump tank falls to a low level position and switching to motive porting when the fluid level within the pump tank rises to a high level position. An electrical counter circuit is operatively connected to the pump tank for incrementing a stored count in response to the fluid level within the pump tank rising to a predetermined level.

35 Claims, 5 Drawing Sheets

GAS PRESSURE DRIVEN FLUID PUMP HAVING AN ELECTRONIC CYCLE COUNTER AND METHOD

BACKGROUND OF THE INVENTION

The present invention relates generally to the art of gas pressure driven fluid pumps. More particularly, the invention relates to such a pump which includes an electronic cycle counter.

Condensate removal systems in steam piping arrangements often utilize gas pressure driven pumps. In general, these types of pumps operate on a positive displacement principle to pump liquid. Rather than reciprocating a piston in a chamber, however, the pressurized gas is introduced into the pump housing so as to displace the liquid.

Attempts have been made to count the cycles of gas-pressure driven pumps. For example, U.S. Pat. No. 5,517,008 to Francart, Jr. describes a mechanical cycle counter for such a pump. The counter has a piston that moves as pressure rises within the pump tank. The upper end of the piston moves a counter oscillation arm, which thereby increments the counter. While this design generally works well, the mechanical nature of the design requires complex moving parts and is difficult to monitor from a remote location.

SUMMARY OF THE INVENTION

The present invention recognizes and addresses the foregoing considerations, and others, of prior art constructions and methods.

In one aspect, the invention provides a gas pressure driven fluid pump. The pump has a pump tank with a liquid inlet and a liquid outlet. A switching mechanism is operative within the pump tank for switching between exhaust porting and motive porting. An electronic counter is operatively connected to the pump tank for incrementing a stored count in response to the fluid level within the pump tank rising to a predetermined level.

In some exemplary embodiments, the electronic counter circuit has a first lead and a second lead in which electrical communication between the first lead and the second lead increments the stored count. Preferably, the first lead and the second lead come into electrical communication due to the conductivity of fluid within the pump tank. In some embodiments, the electronic counter has a probe extending into the pump tank, which is in electrical communication with the first lead, such that the first lead and the second lead come into electrical communication when the fluid within the pump tank rises to a level to contact the probe.

Other aspects of the present invention are achieved by a device for counting the cycles of a pump. The device has a counter circuit with a first lead and a second lead. The counter circuit increments a stored count in response to electrical communication between the first lead and the second lead. The first lead and the second lead are configured to come into electrical communication when fluid within the pump rises to a predetermined level.

For some embodiments, a display may be provided for displaying the stored count. Embodiments are also contemplated in which a transmitter is provided for transmitting the stored count to a remote receiver. For example, the transmitter may be configured to wirelessly transmit the stored count.

Additional aspects of the invention are achieved by a gas pressure driven fluid pump. The pump has a pump tank with a liquid inlet and a liquid outlet. A switching mechanism is operative within the pump tank for switching between exhaust porting and motive porting. Sensor means is provided for passively detecting when the fluid level within the pump tank reaches a predetermined level. Counter means is provided for incrementing a stored count in response to the sensor means.

In some exemplary embodiments, the sensor means is an electrical circuit having a first lead and a second lead in which electrical communication between the first lead and the second lead indicates that the predetermined fluid level within the pump has been reached. Often, the first lead and the second lead are adapted to come into electrical communication due to the conductivity of fluid within the pump tank when the fluid level within the pump tank reaches a predetermined level. Some embodiments contemplate that a probe will be in electrical communication with the first lead, such that the first lead and the second lead come into electrical communication when the fluid within the pump rises to a level to contact the probe.

Still further aspects of the invention are achieved by a method of electrically counting cycles of a gas pressure driven pump. One step of the method involves detecting when the fluid level within a pump tank rises to a predetermined level. In response to the detection of the fluid level rising to the predetermined level, an electrical signal is generated. In response to the electrical signal, the stored count on an electrical counter is incremented.

In some exemplary embodiments, an electrical circuit may be provided to indicate when the predetermined level has been reached. For example, the electrical circuit may have a first lead and a second lead in which electrical communication therebetween indicates that the predetermined fluid level has been reached. Preferably, the first lead and the second lead are adapted to come into electrical communication due to the conductivity of fluid within the pump tank when the fluid level within the pump tank reaches a predetermined level.

In some embodiments, the stored count may be transmitted to a remote receiver. In such embodiments, the stored count may be remotely received. It is also contemplated that the stored count may be displayed.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof to one of ordinary skill in the art, is set forth more particularly in the remainder of the specification, which makes reference to the accompanying drawings, in which.

Figure 1:
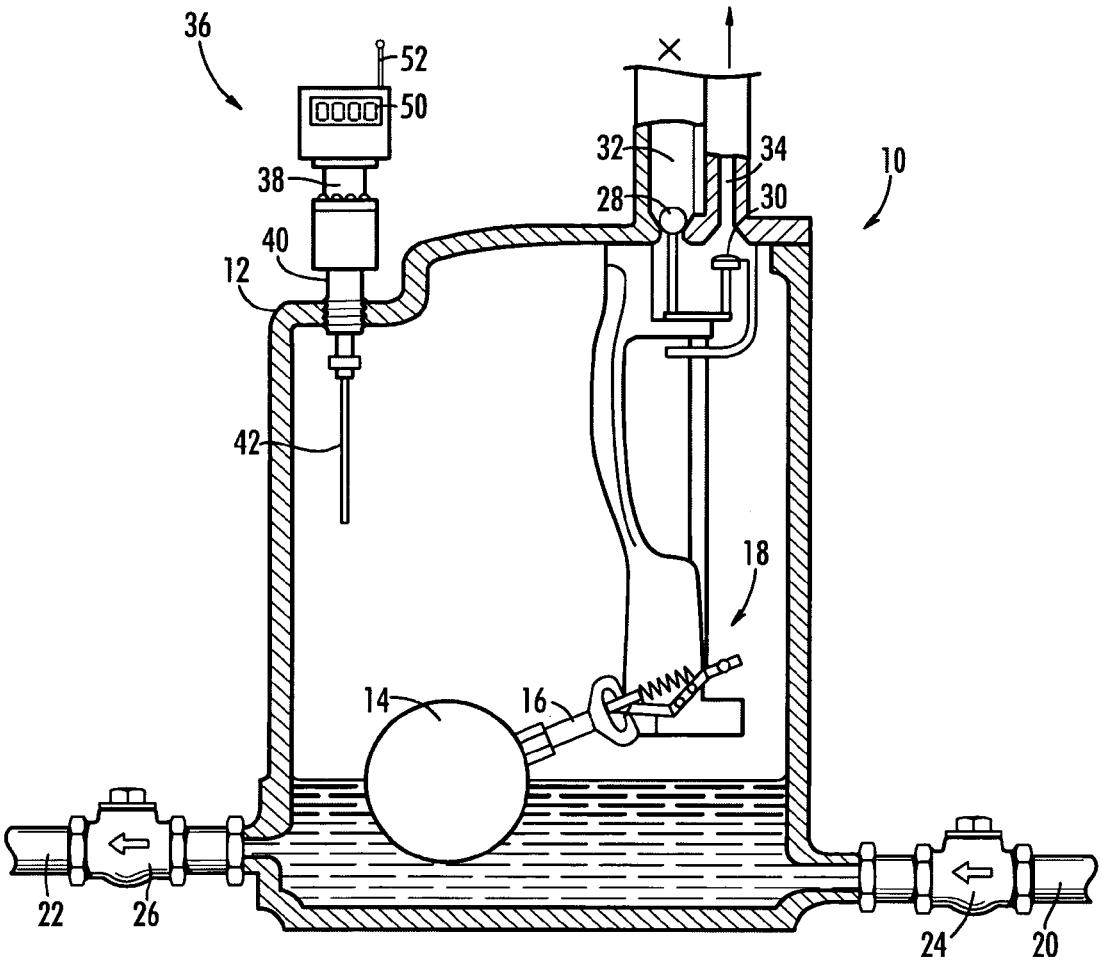
FIG. 1 is a side cross sectional view of a pressure driven pump (in the liquid filling phase) utilizing an electronic cycle counter constructed in accordance with the present invention.

Repeat use of reference characters in the present specification and drawings is intended to represent same or analogous features or elements of the invention.

DETAILED DESCRIPTION OF THE EXEMPLARY EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

Figure 2:
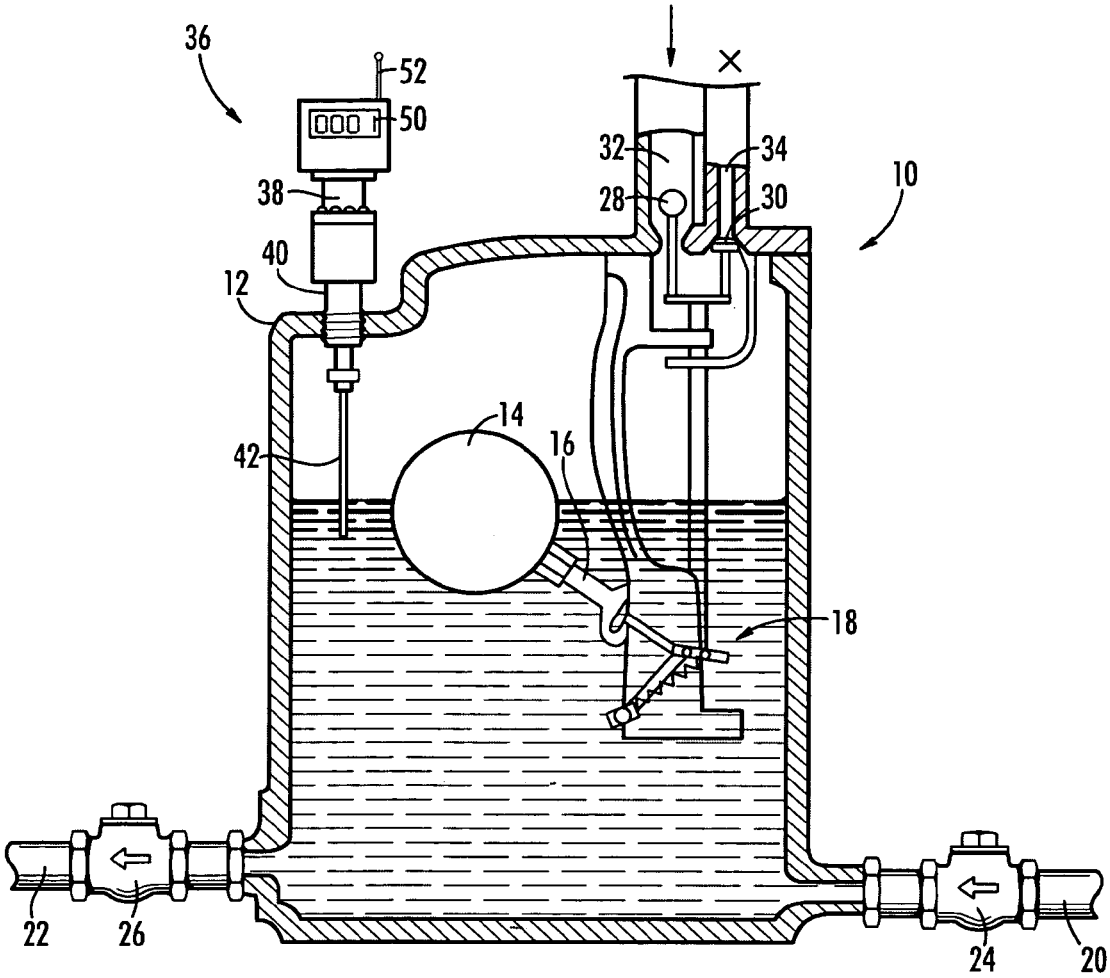
FIG. 2 is a view similar to FIG. 1 in which the pump is in the liquid discharge phase.

FIGS. 1 and 2 illustrate a gas pressure powered fluid pump, generally referred to by reference number 10, constructed according to an embodiment of the present invention. As shown, pump 10 has a tank 12 defining an interior in which a float 14 is located. Float 14 is attached to the end of a float arm 16 that is operatively connected to a switching mechanism 18. A liquid inlet 20 and a liquid outlet 22, which are located near the bottom of tank 12, are typically equipped with an inlet check valve 24 and an outlet check valve 26 to permit liquid flow only in the pumping direction.

Switching mechanism 18 is preferably a snap-acting linkage interconnected to a motive valve 28 and an exhaust valve 30, which function to introduce motive gas into and exhaust gas out of the interior of tank 12 based on the position of float 14. Toward this end, a motive pipe 32 is connected between motive valve 28 and a source of motive gas, such as a source of steam. Similarly, a balance pipe 34 is connected between exhaust valve 30 and a suitable sink to which gas inside of tank 12 can be exhausted. In some cases, for example, balance pipe 34 can terminate such that the gas will simply exhaust to the ambient atmosphere.

Pump 10 operates by alternating between a liquid filling phase and a liquid discharge phase. During the liquid filling phase (FIG. 1), motive valve 28 is closed while exhaust valve 30 is open, thereby causing the fluid level within tank 12 to rise. When the fluid level within tank 12 reaches a high level position, switching mechanism 18 switches to "motive porting" by simultaneously opening motive valve 28 and closing exhaust valve 30. As a result, pump 10 will switch to the liquid discharge phase.

In the liquid discharge phase (FIG. 2), steam or other motive gas is introduced into tank 12 through motive pipe 32, thereby causing liquid to be expelled from tank 12. When the fluid level within tank 12 reaches a low level position, switching mechanism 18 switches to "exhaust porting" by simultaneously opening exhaust valve 30 and closing motive valve 28. As a result, pump 10 will again be in the liquid filling phase.

Switching mechanism 18 is typically a mechanical device configured to switch to exhaust porting when the fluid level within tank 12 reaches a low level position and to switch to motive porting when the fluid level within tank 12 reaches a high level position. U.S. Pat. No. 5,938,409 to Radle (incorporated herein by reference), describes a suitable switching mechanism with a pair of valves interconnected by a snap-acting linkage control.

Other suitable switching mechanisms have also been devised. For example, U.S. Ser. No. 10/214,513 titled "Gas Pressure Driven Fluid Pump Having Snap-Acting Rotary Valve," filed Aug. 8, 2002, Ser. No. 10/287,255 titled "Gas Pressure Driven Fluid Pump Having Pilot Valve Controlling Disc-Type Motive and Exhaust Valves," filed Nov. 4, 2002, Ser. No. 10/374,206 titled "Gas Pressure Driven Fluid Pump Having Magnetic Valve Control Mechanism and Method," filed Feb. 26, 2003 and Ser. No. 10/729,355 titled "Gas Pressure Fluid Pump Having Compression Spring Pivot Mechanism and Damping System," filed Dec. 5, 2003 (all of which are hereby incorporated by reference) each describe switching mechanisms suitable for use in the present invention.

An electronic cycle counter 36 indicates the number of times that the fluid level within pump tank 12 rises to a predetermined level, thereby counting the cycles of pump 10. As a result, the operation of pump 10 can be verified by maintenance personnel. In addition, counter 36 can be used as a flow metering device since the swept volume of the pump multiplied by the number of strokes gives the volume of liquid passing through the pump. This is useful to monitor plant performance and efficiency.

In one embodiment, counter 36 has an upper probe housing 38 and a lower probe housing 40. In the embodiment shown, lower portion of lower housing 40 has external threads that mate to internal threads in tank 12. For example, lower housing could use a taper seal National Pipe thread or a parallel National Pipe thread with a seal nut.

A probe 42 extends from lower housing 40 into the interior of tank 12 for detecting when the fluid level within tank 12 reaches a predetermined level. Although probe 42 could be oriented in numerous manners within tank 12, the tip of probe 42 should be positioned within tank 12 to be immersed by fluid at some point during the liquid filling phase of the pumping cycle. As discussed in more detail below, counter 36 increments when a portion of probe 42 contacts fluid within tank 12.

Figure 3:
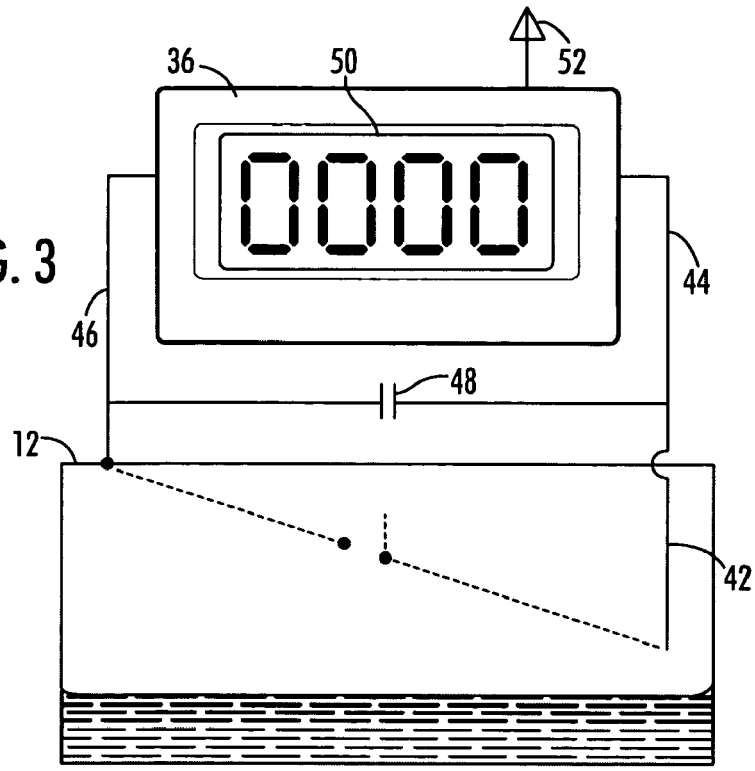
FIG. 3 is a diagrammatical representation of an electronic cycle counter constructed in accordance with the present invention in which the fluid level within the pump tank has not reached a sufficient level to increment the counter.
Figure 4:
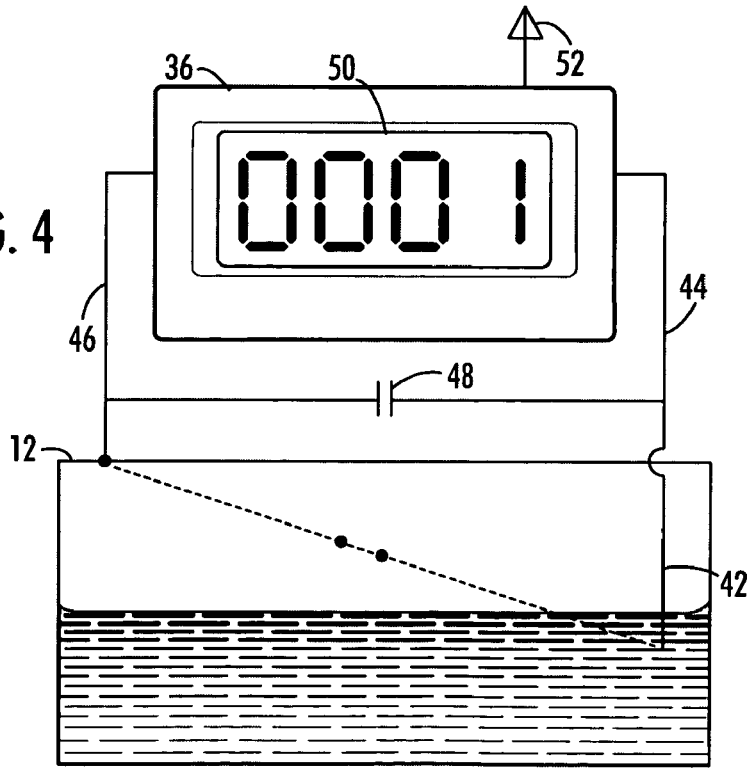
FIG. 4 is a view similar to FIG. 3, but with the fluid level at a sufficiently high level to increment the counter.

Referring to FIGS. 3 and 4, counter 36 has circuitry with a first lead 44 and a second lead 46. The circuitry is configured to increment a stored count each time first lead 44 and second lead 46 come into electrical communication. By the term "electrical communication," it is meant a closed electrical circuit through which current flows. Any electrical circuit (either analog or digital) which increments a stored count when two inputs come into electrical communication would be suitable for the present invention. In one embodiment, for example, an integrated circuit in which the leads are inputs and the stored count is an output is utilized for this purpose. As one skilled in the art will recognize, an internal battery or other suitable power source is provided to power the circuitry. For example, a counter display unit sold under the name Model CUB7 Miniature Electronic Counter distributed by Red Lion Controls of York, Pa. would be a suitable counter circuit.

In the embodiment shown, first lead 44 is electrically connected to probe 42 while second lead 46 is electrically grounded to tank 12. (Both probe 42 and tank 12 are formed from electrically conductive material, such as steel.) When the fluid level within tank 12 rises sufficiently to contact probe 42, first lead 44 and second lead 46 come into electrical communication due to the conductivity of fluid within tank 12. In other words, the conductivity of fluid within tank 12 provides an electrical path from probe 42 to tank 12, causing first lead 44 and second lead 46 to come into electrical communication. The fluid within tank 12 thus acts as a switch between first lead 44 and second lead 46. When the "switch" is closed, the stored count maintained by counter 36 is incremented by one.

Without sufficient fluid within tank 12 to contact probe 42, there is not an electrical path from probe 42 to tank 12. Thus, first lead 44 and second lead 46 would not be in electrical communication. As a result, the stored count will remain unchanged. Accordingly, counter 36 counts the cycles of pump 10 without any moving parts.

In one embodiment, a capacitor 48 is connected across first lead 44 and second lead 46. As one skilled in the art will recognize, capacitor 48 will serve to filter transient signals appearing at probe 48. As a result, first lead 44 and second lead 46 will not be in electrical communication until capacitor 48 is fully charged. This advantageously eliminates the effects of splashing that might otherwise give false counts.

As shown, counter 36 preferably includes a display 50 for displaying the stored count. It should be appreciated that any suitable display, such as an LED array, could be used for this purpose. Counter 36 could also be adapted to communicate the stored count to a remote location, such as using a hard-wired connection or wireless communications. In this case, for example, counter 36 is equipped with a wireless transmitter 52.

Figure 5:
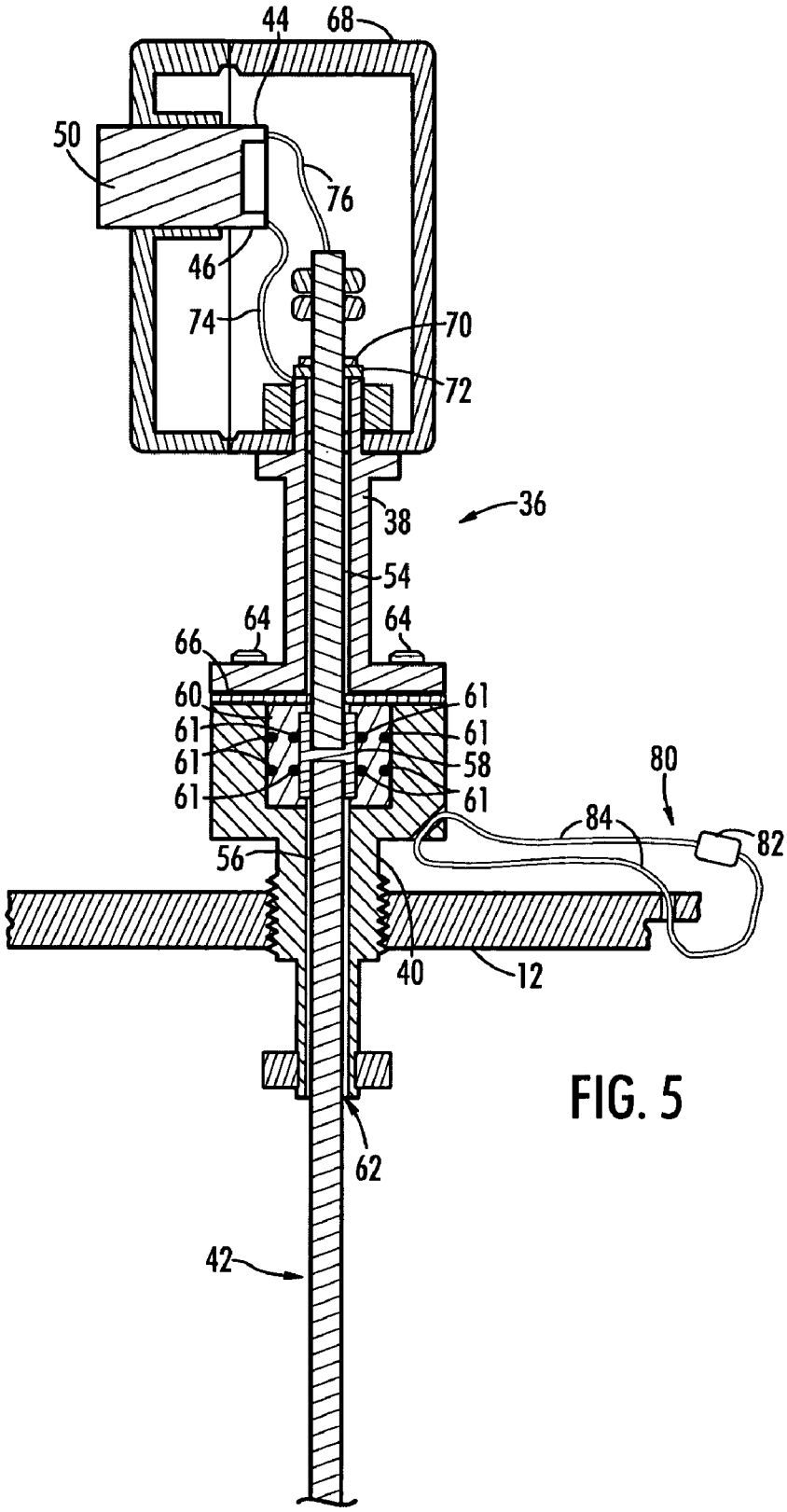
FIG. 5 is a side cross sectional view of an electric cycle counter constructed in accordance with the present invention.

An exemplary construction of counter 36 is shown in FIG. 5. Although it should be appreciated that probe 42 could be formed as an unitary member, in this embodiment probe 42 includes a first member 54 and a second member 56. This construction reduces the possibility that the high-pressure within tank 12 will inadvertently propel first member 54 of probe 42 outside of tank 12; instead, second member 56 will likely be broken off inside of tank 12.

In the illustrated embodiment, first member 54 and second member 56 are joined together using connector 58. It should be appreciated that connector 58 should be formed from an electrically conductive material, such as steel, to provide electrical communication between members 54 and 56. Connector 58 preferably has internal threads that mate to external threads of members 54 and 56. One skilled in the art will appreciate that members 54 and 56 could be alternatively joined using any suitable connection, such as an interference fit or adhesive.

A seal 60 surrounds connector 58 to maintain the position of probe 42 and also to insulate probe 42 from electrical communication with lower housing 40. Seal 60 could be formed from any suitable material having electrical insulating properties, which can withstand the operating conditions within pump tank 12. For example, a suitable heat resisting polymer, such as polyetheretherketone (also known as PEEK) could be used. O-rings 61 or the like may be provided around seal 60 to provide an additional fluid barrier.

Lower housing 40 defines a through-bore 62 of sufficient size to accommodate second member 56 of probe 42 such that lower housing 40 does not contact second member 56 of probe 62 and thereby cause electrical communication therebetween. As shown, a cavity is defined in the upper portion of lower housing 40 to accommodate connector 58 and seal 60.

The upper portion of lower housing 40 is connected to a lower flanged portion of upper housing 38 using screws 64 or other suitable connector. A gasket 66 or the like may be provided between mating surfaces. Upper housing 38 has a through-bore of sufficient size to accommodate first member 54 of probe 42, such that first member 54 does not contact upper housing 38 and cause electrical communication therebetween.

The top end of upper housing 38 is connected to an enclosure box 68 for holding the circuitry associated with counter 36. As shown, a retainer ring 70 connects upper housing 38 with enclosure box 68 in this embodiment. A bushing 72, formed from a material having electrically insulating properties, is positioned between the upper end of first member 54 and retainer ring 70 to prevent electrical communication between probe 42 and upper housing 38.

A ground wire 74 is electrically connected between upper housing 38 and second lead 46 of counter 36. Due to the electrical path from upper housing 38 to tank 12 (through threads mounting lower housing 40 to tank 12 and screws 64), second lead 46 of counter 36 is electrically grounded to tank 12. A probe wire 76 electrically connects first member 54 of probe 42 to first lead 44 of counter 36. Accordingly, first lead 44 is electrically connected to probe 42.

In one embodiment, a locking device 80 is provided to prevent tampering with the number of cycles listed on counter 36. This is particularly useful when the number of cycles listed on counter 36 determines whether pump 10 is still covered by a warranty. For example, pump 10 may be warranted against failures for a certain number of cycles. If a pump owner makes a warranty claim, the number of cycles listed on counter 36 could either support or refute the claim. As shown, locking device is a lock 82 with wires 84 passing through lower housing 40 and tank 12. A unique identifier may be provided on lock for further security.

Figure 6:
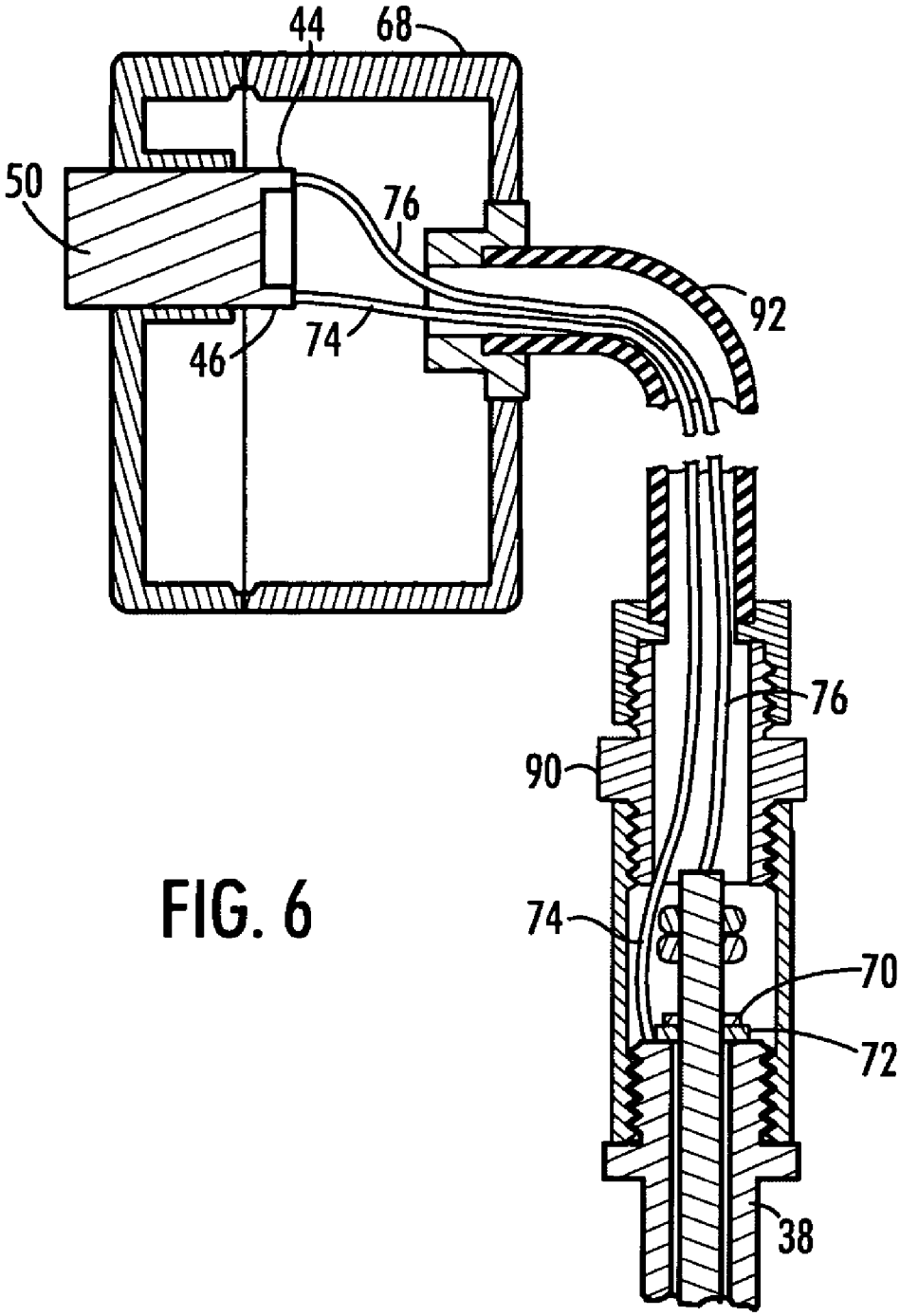
FIG. 6 is a side cross sectional view similar to FIG. 5, but an embodiment in which the display is at a remote position from pump.

In an embodiment shown in FIG. 6, enclosure box 68 with display 50 may be remotely positioned from pump 10. Depending upon the environment and space in which pump is used, this would allow display 50 to be placed in a convenient position for reading the number of cycles shown on display 50. As shown, a conduit adapter 90 and conduit 92 connects upper housing 38 to enclosure box 68. It should be appreciated by one of ordinary skill in the art, any suitable conduit could be used to connect upper house 38 to enclosure box 68.

Further details regarding the operation of the counter 36 will now be described with reference to FIGS. 3 and 4, starting with the initial pump cycle in which counter 36 has a stored count of zero. During the liquid filling phase, the liquid level within tank 12 will initially not be sufficient to contact probe 42. Accordingly, first lead 44 and second lead 46 are not in electrical communication because there is not an electrical path between probe 42 and tank 12. Thus, the stored count of counter 36 remains at zero (see FIG. 3).

However, at some point during the liquid filling phase, the fluid level within tank 12 will rise sufficiently to contact the tip of probe 42. When this occurs, the conductivity of the fluid will create an electrical path between probe 42 and tank 12, thereby causing electrical communication between first lead 44 and second lead 46. Due to the electrical communication between first lead 44 and second lead 46, the stored count on counter 36 will increment (see FIG. 4).

Although first lead 44 and second lead 46 remain in electrical communication until some point in the liquid discharge stage when the fluid level lowers sufficiently to no longer contact probe 42, counter 36 will not further increment the stored count. Instead, counter 36 will increment its stored count only once each time pump is in the liquid filling phase.

While preferred embodiments of the invention have been shown and described, modifications and variations may be made thereto by those of ordinary skill in the art without departing from the spirit and scope of the present invention. It should also be understood that aspects of the various embodiments may be interchanged both in whole or in part. Furthermore, those of ordinary skill in the art will appreciate that the foregoing description is by way of example only and is not intended to be limitative of the invention as further described in the appended claims.

What is claimed is:

1. A gas pressure driven fluid pump, said pump comprising:

a pump tank having a liquid inlet and a liquid outlet;

a switching mechanism operative within said pump tank for switching between exhaust porting and motive porting; and an electronic counter operatively connected to said pump tank for incrementing a stored count in response to the fluid level within said pump tank rising to a predetermined level.

2. The pump as recited in claim 1, wherein said electronic counter has a first lead and a second lead whereby electrical communication between said first lead and said second lead increments said stored count.

3. The pump as recited in claim 2, wherein said first lead and said second lead come into electrical communication due to the conductivity of fluid within said pump tank when the fluid level within said pump tank reaches a predetermined level.

4. The pump as recited in claim 3, wherein said electronic counter has a probe in electrical communication with said first lead and extending into said pump tank, said first lead and said second lead coming into electrical communication when the fluid within said pump tank rises to a level to contact said probe.

5. The pump as recited in claim 4, wherein said probe includes a first member connected to a second member.

6. The pump as recited in claim 4, wherein said pump tank is formed from an electrically conductive material and said second lead is electrically grounded to said pump tank.

7. The pump as recited in claim 6, wherein said pump tank is formed substantially from metal.

8. The pump as recited in claim 6, further comprising at least one capacitor electrically connected across said first lead and said second lead.

9. The pump as recited in claim 1, wherein said electronic counter includes a display for displaying said stored count.

10. The pump as recited in claim 1, wherein said electronic counter includes a transmitter for wirelessly transmitting said stored count to a remote receiver.

11. The pump as recited in claim 1, further comprising a float assembly including a buoyant float carried within the interior of said pump tank, said float being operatively connected to said switching mechanism.

12. A device for counting the cycles of a pump, said device comprising:

a counter circuit having a first lead and a second lead, said counter circuit incrementing a stored count in response to electrical communication between said first lead and said second lead; and whereby said first lead and said second lead are configured to come into electrical communication when fluid within said pump rises to a predetermined level.

13. The device as recited in claim 12, wherein said first lead and said second lead come into electrical communication due to the conductivity of fluid within the pump.

14. The device as recited in claim 12, further comprising a probe in electrical communication with said first lead, wherein said first lead and said second lead come into electrical communication when the fluid within said pump rises to a level to contact said probe.

15. The device as recited in claim 13, wherein said second lead is electrically grounded to the pump.

16. The device as recited in claim 12, wherein said device includes a display for displaying said stored count.

17. The device as recited in claim 12, wherein said device includes a transmitter for transmitting said stored count to a remote receiver.

18. The device as recited in claim 17, wherein said transmitter is configured to wirelessly transmit said stored count.

19. A gas pressure driven fluid pump, said pump comprising:

a pump tank having a liquid inlet and a liquid outlet;

a switching mechanism operative within said pump tank for switching between exhaust porting and motive porting;

sensor means for passively detecting when the fluid level within said pump tank reaches a predetermined level; and counter means for incrementing a stored count in response to said sensor means.

20. The pump as recited in claim 19, wherein said sensor means is an electrical circuit having a first lead and a second lead whereby electrical communication between said first lead and said second lead indicates that the fluid level within said pump tank has reached said predetermined level, said first lead and said second lead adapted to come into electrical communication due to the conductivity of fluid within said pump tank when the fluid level within said pump tank reaches a predetermined level.

21. The pump as recited in claim 20, wherein said sensor means includes a probe in electrical communication with said first lead and extending into said pump tank, said first lead and said second lead coming into electrical communication when the fluid within said pump tank rises to a level to contact said probe.

22. The pump as recited in claim 21, wherein said second lead is electrically grounded to said pump tank.

23. The pump as recited in claim 19, further comprising transmitter means for transmitting said stored count to a remote receiver.

24. A method of electrically counting cycles of a gas pressure driven pump comprising the steps of:

a. detecting when the fluid level within a pump tank rises to a predetermined level;

b. generating an electrical signal responsive to said detecting step; and c. incrementing a stored count on an electrical counter responsive to said generating step.

25. The method as recited in claim 24, wherein an electrical circuit having a first lead and a second lead is used in said detecting step whereby electrical communication between said first lead and said second lead indicates that said predetermined fluid level has been reached, said first lead and said second lead adapted to come into electrical communication due to the conductivity of fluid within said pump tank when the fluid level within said pump tank reaches a predetermined level.

26. The method as recited in claim 24, further comprising the step of transmitting said stored count to a remote receiver.

27. The method as recited in claim 26, further comprising the step of receiving said stored count.

28. The method as recited in claim 24, further comprising the step of displaying said stored count.

29. A gas pressure driven fluid pump, said pump comprising:

a pump tank having a liquid inlet and a liquid outlet;

a switching mechanism operative within said pump tank for switching between exhaust porting and motive porting;

a probe extending into said pump tank through an electrical insulator; and an electronic counter operatively connected to said pump tank for incrementing a stored count in response to the fluid level within said pump tank rising to a level to contact said probe.

30. The pump as recited in claim 29, wherein said electronic counter has a first lead and a second lead whereby electrical communication between said first lead and said second lead increments said stored count.

31. The pump as recited in claim 30, wherein said pump tank is formed from an electrically conductive material and said second lead is electrically grounded to said pump tank.

32. The pump as recited in claim 31, wherein said probe is in electrical communication with said first lead, said first lead and said second lead coming into electrical communication when the fluid within said pump tank rises to a level to contact said probe.

33. The pump as recited in claim 32, wherein said first lead and said second lead are adapted to come into electrical communication due to the conductivity of fluid within said pump tank.

34. The pump as recited in claim 32, further comprising at least one capacitor electrically connected across said first lead and said second lead.

35. The pump as recited in claim 29, wherein said electrical insulator is formed from polyetheretherketone.

* * * * *